United States Patent [19]

Bagaric et al.

[11] Patent Number: 4,505,207

[45] Date of Patent: Mar. 19, 1985

[54] CRANE ANTI-SKEWING DEVICE

[75] Inventors: Stjepan Bagaric, North Vancouver; Gunter Pietsch, Surrey, both of Canada

[73] Assignee: Heede International Ltd., Port Moody, Canada

[21] Appl. No.: 198,098

[22] Filed: Oct. 20, 1980

[51] Int. Cl.[3] ..... B61D 1/00; B61D 15/00; B61F 17/00

[52] U.S. Cl. ..... 105/163 SK; 105/171

[58] Field of Search ..... 105/163 R, 163 S, 163 SK, 105/171

[56] References Cited

U.S. PATENT DOCUMENTS

| | | | |
|---|---|---|---|
| 1,181,324 | 5/1916 | Lent | 105/163 SK X |
| 2,601,831 | 7/1952 | Caillard | 105/163 SK X |
| 2,932,260 | 4/1960 | Puma et al. | 105/163 SK |
| 2,935,032 | 5/1960 | Tingskog | 105/163 SK X |
| 2,955,546 | 10/1960 | Liebherr et al. | 105/163 R X |
| 2,974,606 | 3/1961 | Macrander | 105/163 R X |
| 3,166,023 | 1/1965 | Lynd, Jr. | 105/163 R |
| 3,204,577 | 9/1965 | Smith | 105/163 R |
| 3,703,016 | 11/1972 | Schramm et al. | 105/163 SK X |
| 4,022,133 | 5/1977 | Lindblom et al. | 105/171 X |

FOREIGN PATENT DOCUMENTS

| | | | |
|---|---|---|---|
| 1109338 | 6/1961 | Fed. Rep. of Germany SK | 105/163 |
| 1120658 | 12/1961 | Fed. Rep. of Germany SK | 105/163 |
| 575727 | 4/1958 | Italy | 105/163 SK |

OTHER PUBLICATIONS

Harper, Charles A.; "Handbook of Components for Electronics"; copyright 1977; switches 10–93.

Shields, John Potter; How to Build–Proximity Detectors & Metal Locators; Second Edition First Printing–1972; pp. 25, 26, 47, 52, 55, 61, and 87.

*Primary Examiner*—Robert B. Reeves
*Assistant Examiner*—Howard Beltran
*Attorney, Agent, or Firm*—Townsend and Townsend

[57] ABSTRACT

An anti-skewing device for a bridge crane comprises a proximity switch near a first side of a first track and near a first end of the crane for detecting the proximity of the switch to the first side of the first track and thereby any skewing of the crane. There is an electrically activated brake for each set of wheels. A circuit connects the proximity switch to each of the brakes to slow one end of the crane relative to another end and thereby correct any skewing during movement of the crane.

8 Claims, 8 Drawing Figures

Fig. 1.
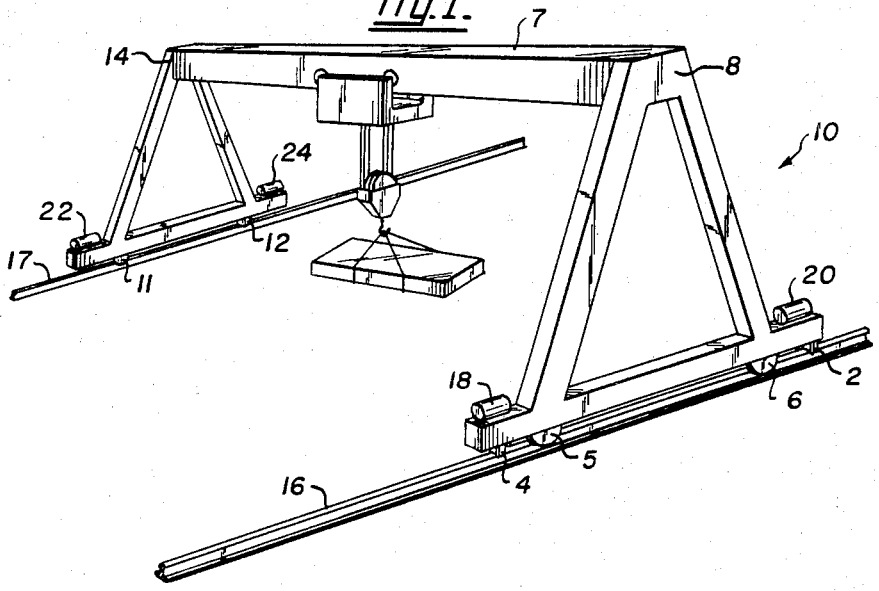
Fig. 2.
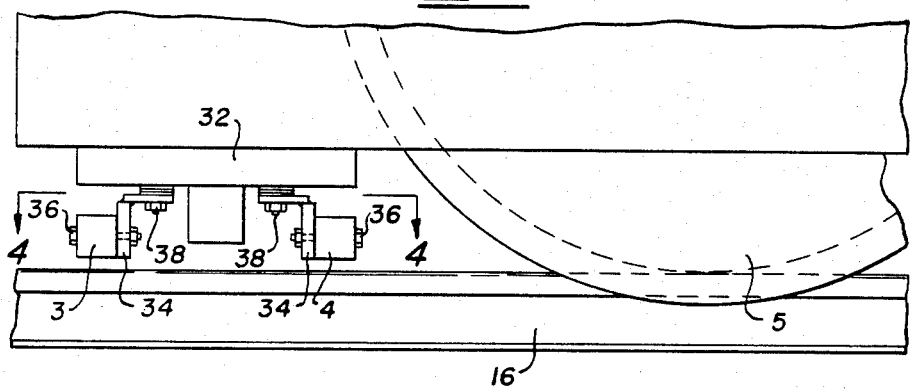
Fig. 3.
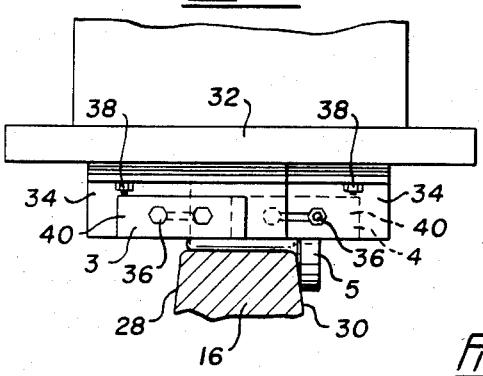
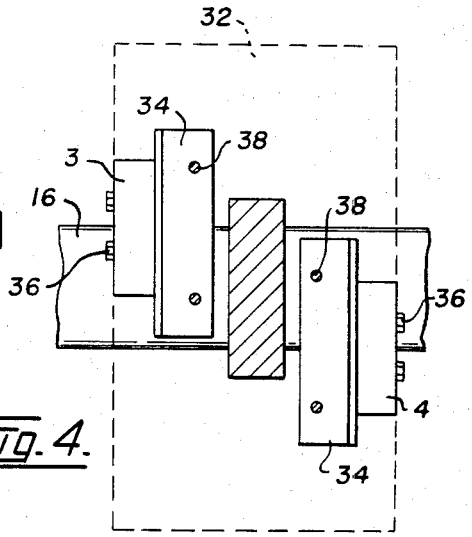
Fig. 4.

CRANE ANTI-SKEWING DEVICE

BACKGROUND OF THE INVENTION

The invention relates to an anti-skewing device for a crane having a bridge with a set of wheels near opposite ends thereof.

Travelling bridge cranes, including gantry cranes and overhead cranes, travel along spaced-apart rails rear opposite ends of the bridge. A problem commonly arises where one end of the bridge lags behind the other as the crane travels along the rails. This condition is referred to as "skewing" and is undesirable because of the resulting stresses on the crane structure and the hinderance to the smooth travel of the crane along the tracks. This problem could eventually cause structural failure of the crane or possibly the derailment of the crane.

Because of this problem, various mechanisms have been developed to retard the leading end of the crane relative to the opposite end so that the proper condition is restored where the two ends of the crane are at the same longitudinal position with respect to the tracks. For example, U.S. Pat. No. 3,166,023 to Lynd discloses an anti-skew device for an overhead crane wherein rollers detect skewing of the crane. The rollers are connected to switches and a circuit arrangement whereby the skewing of the crane is corrected by frictional drag. In U.S. Pat. No. 1,181,324 to Lent, forked extensions of operating members detect the skewing. The operating members activate switches controlling the motors of the crane. An overhead crane with skew control is shown in U.S. Pat. No. 3,204,577 to Smith which includes a bridge skew detector carried by the bridge and a motor controller sensitive to the skew detector for adjusting the rate of movement of one of the bridge ends.

In U.S. Pat. No. 3,703,016 to Schramm, relative rotation of two cylindrical wheels indicates bridge misalignment and adjusts the two power supplies to correct the misalignment.

Similar mechanisms can be found in U.S. Pat. Nos. 2,932,260 to Puma, 2,601,831 to Caillard, 2,955,546 to Leibherr, 2,935,032 to Tingskog and 2,974,606 to Macrawder as well as Italian Pat. No. 575,727 and German Pat. Nos. 1,109,338 and 1,120,658.

The suitability and acceptance of some prior art anti-skewing devices has been restricted due to certain disadvantages. For example, the response time of some earlier systems has been too slow for the skewing to be corrected at the time required. This could lead to the highly undesirable condition where the skewing has actually reversed by the time the correction occurs. Additionally, on those earlier systems employing mechanical devices such as rollers contacting the rails to detect skewing, the accuracy of the devices or their durability is adversely affected by accumulations of debris as commonly found at industrial sites.

SUMMARY OF THE INVENTION

According to the invention, an anti-skewing device is provided for a crane having a bridge with a set of wheels near the opposite ends thereof for travelling along parallel tracks. The anti-skewing device comprises a proximity switch near a first end of a first track and near a first said end of the crane for detecting the proximity of the switch to the first side of the first track and thereby any skewing of the crane. There is an electrically activated wheel brake for each said set of wheels. A circuit connects the proximity switch to each of the wheel brakes to slow one said end of the crane relative to another said end of the crane and thereby correct any skewing during movement of the crane.

Preferably, there is a first said proximity switch near said first side of the first track for detecting proximity to said first side, a second said proximity switch adjacent the first switch and near a second side of the first track, opposite the first side, for detecting proximity to said second side, a third said proximity switch spaced-apart from the first and second switches along the first track and near the first side of the first track for detecting proximity to the first side, and a fourth said proximity switch adjacent the third switch and near the second side of the first track for detecting proximity to the second side. During movement of the crane in a first direction along the tracks, the circuit connects the first and fourth switches to the wheel brakes of a first set of wheels near the first end of the crane and connects the second and third switches to the wheel brakes of a second set of wheels near a second end of the crane opposite the first end. During movement of the crane in a second direction opposite to the first direction, the first and fourth switches are connected to the wheel brakes of the second set of wheels and the seond and third switches are connected to the wheel brakes of the first set of wheels.

In a preferred form of the invention, the wheel brakes comprise eddy current brakes.

The present invention offers an anti-skewing device which is extremely responsive and reduces the lag between the time when the skewing is detected and when the correction occurs. This overcomes a problem associated with many prior art devices of the type. Moreover, by employing proximity switches in place of mechanical devices to detect the skewing, the sensing devices are unlikely to be damaged by debris near the tracks or to have their accuracy adversely affected thereby.

BRIEF DESCRIPTION OF THE DRAWINGS

In the drawings:

FIG. 1 is a perspective view of a gantry crane fitted with an anti-skewing device according to an embodiment of the invention;

FIG. 2 is an enlarged fragmentary, side elevational view showing the proximity switches of the anti-skewing device of FIG. 1 near one of the wheels at one end of the crane;

FIG. 3 is a front elevational view of the proximity switches of FIG. 2;

FIG. 4 is a sectional view taken along line 4—4 of FIG. 2 and showing the proximity switches in plan;

DESCRIPTION OF THE PREFERRED EMBODIMENTS

Figure 5:
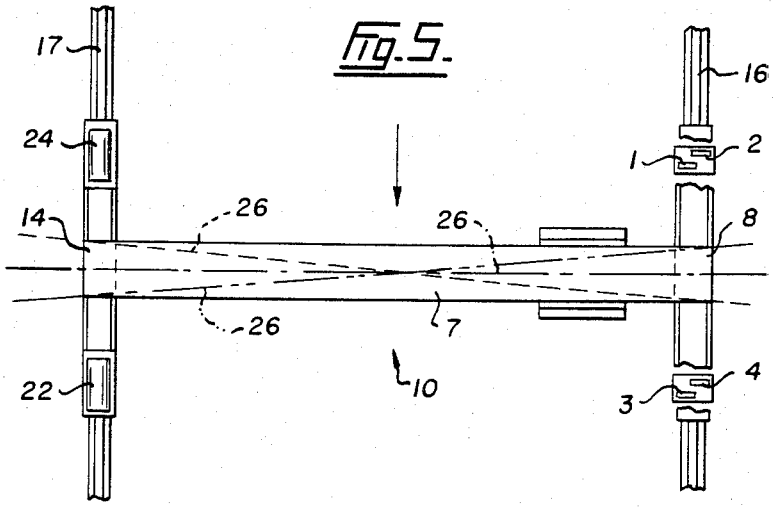
FIG. 5 is a top plan view of the crane of FIG. 1 partly broken away to show the proximity switches.

Referring to the drawings, a gantry crane 10 is illustrated although, it should be noted, that the invention is applicable to other types of bridge craness adapted to travel along spaced-apart tracks. The crane 10 has a bridge 7 with a pair of wheels 5 and 6 near its first end 8 supporting that end and a second pair of wheels 11 and 12 near the second end 14 for supporting that end of the crane. There is a first track 16 along which wheels 5 and 6 travel and a spaced-apart track 17 for wheels 11 and 12. The crane has motors 18 and 20 at the first end for powering the wheels 5 and 6 and motors 22 and 24 at the second end for the wheels 11 and 12.

Because of the independent drive for the opposite ends of the crane, different resistances to travel at the opposite ends and similar factors, skewing of the crane could occur as shown in FIG. 5. Skewing of the crane is possible in two different directions as indicated by the stippled line 26 and the double chain line 26 which could be the position of the center line 26 of bridge 7 during skewing of crane 10. The direction of skewing depends upon which end of the crane is lagging the other and the direction of travel. For reference purposes, the direction indicated by the arrow in FIG. 5 will be described as the forward direction, while the opposite direction is reverse.

During forward movement of the crane, the skewed condition resulting in the position of the center line of bridge 7 as shown by the stippled line will result when the first end 8 of the crane leads and the second end 14 lags. The opposite skewed condition, shown by the double chain line, results when end 14 leads and end 8 lags. In the reverse direction, end 8 leading and end 14 lagging will result in the center line being along the double chain line, while end 14 leading and end 8 lagging will result in the skewed condition shown by the stippled line.

Figure 7:
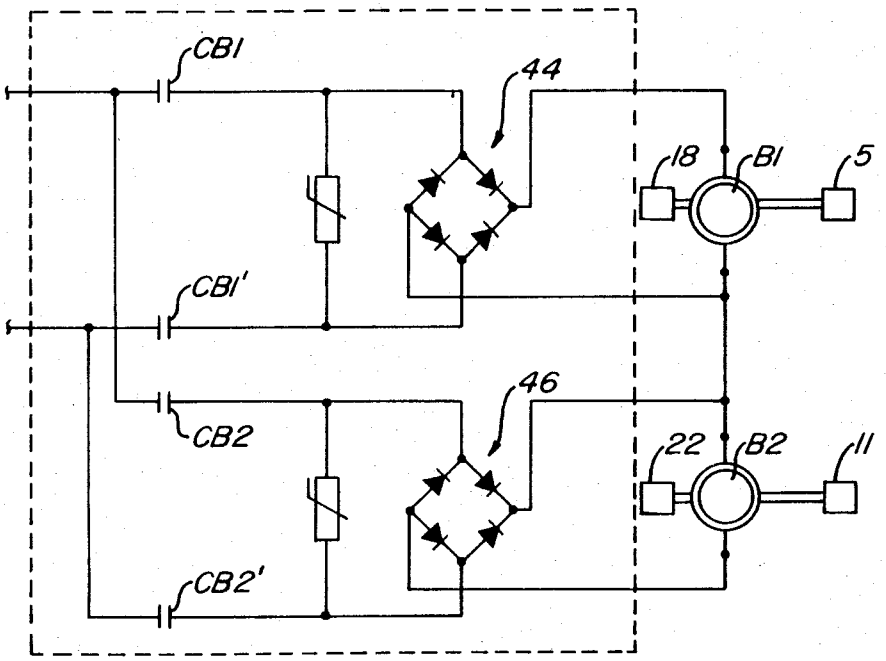
FIG. 7 is a schematic wiring diagram showing the rectifier circuits and eddy current brakes of the crane of FIG. 1 and the mechanical connection between the motors, eddy current brakes and wheels.
Figure 8:
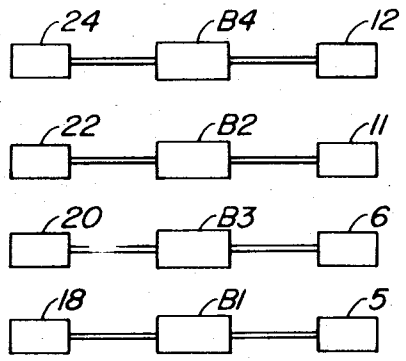
FIG. 8 schematically illustrates the mechanical connections within four sets of motors, eddy current brakes and wheels.

The skewed condition is corrected by applying a braking force to the leading end of the crane. In the preferred embodiment, the wheel braking is provided by two eddy current brakes B1 and B2 shown schematically in FIG. 7. An example of such a brake is sold by Harnischfegerf Corp. of Brookfield, Wis. as Model 1412. These brakes are mechanically coupled to at least one of the motors at each end of the crane as shown in FIG. 7. Eddy current brake B1 is connected to motor 22 at the first end 8, to motor 18, while brake B2 is connected to motor 22 at the second end 14. FIG. 8 schematically illustrates the use of four eddy current brakes B1, B3, B2, and B4 and the mechanical coupling between motors 18, 20, 22 and 24, eddy current brakes B1, B3, B2 and B4 and wheels 5, 6, 11 and 12 respectively.

The sensing mechanism for determining whether a skewed condition exists consists of the commercially available proximity switches 1, 2, 3 and 4 positioned on the crane as shown best in FIG. 5. Such switches are available from Foster Instruments Limited, Toronto, Ontario, Canada, and Louisville, Ky. as its GO-SWITCH (trademark) proximity limit switches. A first pair of proximity switches 1 and 2 are adjacent the wheel 6, while the second pairs 3 and 4 are spaced-apart from the first pair along the track 16 and adjacent the wheel 5. Switches 1 and 3 are near the first or inner side 28 of track 16 which faces track 17 and are positioned so they are activated at a specified proximity thereto. The remaining switches 2 and 4 are near the second or outside 30 of the track 16 and are activated at a similar proximity as switches 1 and 3. When skewing occurs as represented by the stippled line 26, switches 1 and 4 approach the inside 28 and outside 30 of track 16 respectively and the apparatus corrects the skewing by applying the appropriate brake B1, B2. When the crane is moving forwardly in the direction indicated by the arrow, the brake B1 at the first end 8 must be applied to correct the skewing, while brake B2 must be applied if the crane is moving in the reverse direction. When skewing occurs in the direction indicated by the double chain line 26, switches 2 and 3 approach the outside 30 and inside 28 of the rail 16. When the crane is moving forwards, brake B2 at the second end 14 must be applied, while brake B1 at the first end 8 will correct skewing when the crane is moving in the reverse direction.

As shown best in FIGS. 2, 3 and 4, for the switches 3 and 4, a rectangular mounting plate 32 is provided for each pair of proximity switches which are connected thereto by brackets 34 and bolts 36 and 38. The sensing heads 40 of the switches are located outwardly from the sides of the rail 16 of which they are to detect proximity. As seen in FIG. 2, the switches are spaced above the top of the rail 16. The switches are positioned so that they are activated when the sensing head 40 of each moves a specified distance towards one of the sides of rail 16. The arrangement for switches 1 and 2 is identical as shown for 3 and 4.

Each of the proximity switches 1, 2, 3 and 4 is a normally open switch indicated schematically in FIG. 3 which is closed when the sensing head of the switch approaches the side of the rail to within a specified distance. Since the switch 1 is connected across the power source 42 in series with the relay R1, the contact C1 of the relay R1 is closed when proximity switch 1 closes. Similarly, switch 4 is connected to relay R4 and closes its contact C4 when activated. Switches 2 and 3 are connected to relays R2 and R3, respectively, to close contacts C2 and C3 of these relays. Thus relay contacts C1–C4 open according to the opening and closing of proximity switches 1–4 respectively.

Figure 6:
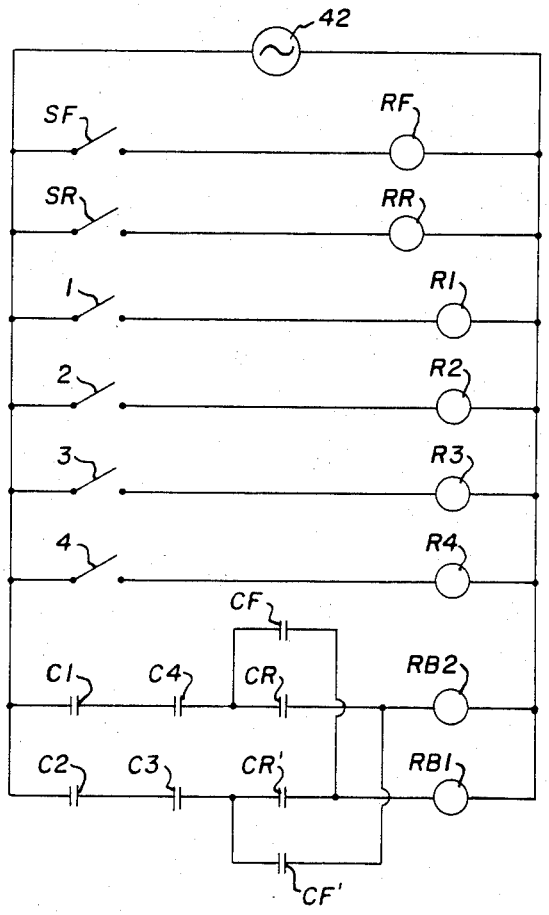
FIG. 6 is a schematic wiring diagram of the circuit connecting the proximity switches.

The crane's forward control is represented schematically in FIG. 6 by switch SF connected to relay RF so that the contacts CF and CF' thereof are closed when the crane moves forwardly. Similarly, the crane reverse control SR is connected to relay RR so that its contacts CR and CR' are closed when the crane moves in reverse.

The relay contacts C1 and C4 are connected in series with relay RB1 through contact CF and with relay RB2 through contact CR. As shown in FIG. 7, the contacts CB1 and CB1' of relay RB1 supply power to eddy brake B1 through the rectifier circuit 44 when relay RB1 is energized to close contacts CB1 and CB1'. Similarly, contacts CB2 and CB2' are closed when relay RB2 is energized to supply power to brake B2 through rectifier circuit 46.

When the crane moves forwardly, forward control switch SF is closed to energize relay RF to close contacts CF and CF'. If the crane is skewed sufficiently, either contacts C1 and C4 are connected in series with relay RB1 to activate eddy brake B1, or contacts C2 and C3 are connected in series with relay RB2 to activate brake B2. If a skew as illustrated by the stippled line of FIG. 5 occurs, the sensing heads 40 of switches 1 and 4 approach the inside 28 and outside 30 of the rail 16. Switches 1 and 4 closed once a specified degree of skew occurs to close contacts C1 and C4 by means of relays R1 and R4 and supply power to brake B1 through contacts CB1 and CB1'. Brake B1 then slows the first side 8 of the crane to correct the skew.

Should the crane skew in the direction indicated by the double chain lines of FIG. 5, during forward motion, the closing of switches 2 and 3 closes contacts C2 and C3 of relays R2 and R3 to supply power to relay RB2 through contact CF' of relay RF. This supplies power to brake B2 through contacts CB2 and CB2' to slow the second end 14 of the crane and correct skewing.

During reverse operation, contacts CR and CR' of relay RR are closed so that contacts C1 and C4 are connected in series with relay RB2. Thus when switches 1 and 2 close during reverse operation, they close contacts C1 and C4 of relays R1 and R4 to supply power to relay RB2 and thereby power to brake B2. This slows end 14 of the crane to correct skewing.

Also during the reverse operation of the crane, slowing of the first end 8 is required to correct skewing in the direction indicated by the double chain lines of FIG. 5 and this is accomplished when proximity switches 2 and 3 approach sides 30 and 28 of track 16 to within the specifed distance. When they close, power is supplied to switch means or rectifiers R2 and R3 to close contacts C2 and C3 and supply power to relay RB1 through contact CR'. The contacts CB1 and CB1' are then closed to supply power to brake B1 and slow end 8.

What is claimed is:

1. An anti-skewing device for a crane having a bridge with a set of wheels at first and second opposite ends thereof for traveling along the first and second parallel tracks, the device comprising:

a proximity switch mounted to the bridge spaced apart from a first side of the first track and near the first end of the crane for detecting the proximity of the switch to the first side of the first track and thereby any skewing of the crane;

electrically activated means, mounted to and carried by the bridge and operably coupled to at least one of the wheels traveling along each of the first and second tracks, for applying a braking force to the wheels; and circuit means, electrically connecting said proximity switch and said braking force applying means, for electrically actuating at least one of said braking force applying means in response to the proximity switch to slow said one end of the crane relative to the other end of the crane and thereby correct any skewing during movement of the crane.

2. An anti-skewing device as claimed in claim 1 comprising a first said proximity switch near but out of contact with said first side of the first track for detecting proximity to said first side, a second said proximity switch adjacent the first switch and near but out of contact with a second side of the first track, said second side being opposite the first side, for detecting proximity to said second side, a third said proximity switch spaced-apart from the first and second switches along the first track and near but out of contact with the first side of the first track for detecting proximity to the first side, and a fourth said proximity switch adjacent the third switch and near but out of contact with the second side of the first track for detecting proximity to the second side, during movement of the crane in a first direction along the tracks, the circuit connecting the first and fourth switches to the braking means of a first set of wheels near the first end of the crane and connecting the second and third switches to the braking means of a second set of wheels near a second end of the crane opposite the first end, and during movement of the crane in a second direction opposite to the first direction, the first and fourth switches being connected to the braking mechanism of the second set of wheels and the second and third switches being connected to the braking mechanism of the first set of wheels.

3. An anti-skewing device as claimed in claim 2, each said set of wheels comprising a pair of wheels near one said end of the crane, the wheels of each pair being spaced-apart along the track travelled by said pair of wheels, the first and second switches being near a first wheel of the pair of wheels near the first end of the crane and the third and fourth switches being near a second wheel of the pair of wheels near the firste end of the crane.

4. An anti-skewing device as claimed in claim 3, each said track having an inside facing the other said track and an outside opposite the inside, the first and third switches being near the inside of the track for detecting proximity thereto and the second and fourth switches being near the outside of the track for detecting proximity thereto.

5. An anti-skewing device as claimed in claim 4, the first and fourth switches being connected to the braking force applying means of the first set of wheels and the second and third switches being connected to the braking force applying means of the second set of wheels when the crane moves along the track in a forward direction where the second wheels of each said pair of wheels proceeds the first wheels, the first and fourth switches being connected to the braking force applying means of the second set of wheels and the second and third switches being connected to the braking force applying means of the first set of wheels when the crane moves in a reverse direction opposite the forward direction.

6. An anti-skewing device as claimed in claim 5, comprising normally open switch means connected to each said proximity switch, each said switch means being closed when the proximity switch connected thereto approaches a track to within a specified distance, a normally open forward switch means which is closed when the crane moves forwards and a normally open reverse switch means which is closed when the crane moves in reverse, the switch means of the first and fourth proximity switches being connected in series with the forward switch means and the braking force applying means of the first set of wheels during forward movement of the crane so the braking force applying means of the first set of wheels is applied to retard the first end of the crane when the first and fourth proximity switches approach the track, the switch means of the first and fourth proximity switches being connected in series with the reverse switch means and the braking force applying means of the second set of wheels during reverse movement of the crane so the braking force applying means of the second set of wheels is applied to retard the second end of the crane when the first and fourth proximity switches approach the track, the switch means of the second and third proximity switches being connected in series with the forward switch means and the braking force applying means of the second set of wheels during forward movement of the crane so the braking force applying means of the second set of wheels is applied to retard the second end of the crane when the second end and third proximity switches approach the track, and the switch means of the second and third proximity switches being connected in series with the reverse switch means and the braking force applying means of the first set of wheels during reverse movement of the crane so the braking force applying means of the first set of wheels is applied to retard the first end of the crane when the second and third proximity switches approach the track.

7. An anti-skewing device as claimed in claim 6, said switch means comprising electrical relays.

8. An anti-skewing device as claimed in claim 6, the braking force applying means comprising eddy current brakes.

* * * * *